US008330774B2

(12) United States Patent
Turcotte et al.

(10) Patent No.: US 8,330,774 B2
(45) Date of Patent: Dec. 11, 2012

(54) SYSTEM COMPOSITING IMAGES FROM MULTIPLE APPLICATIONS

(75) Inventors: Garry Turcotte, Ottawa (CA); David Donohoe, Ottawa (CA); Dan Dodge, Nepean (CA); Peter van der Veen, Ottawa (CA); Steve Tomkins, Ottawa (CA); Xiaodan Tang, Ottawa (CA); Colin Burgess, Ottawa (CA)

(73) Assignee: QNX Software Systems Limited, Kanata, Ontario (CA)

( * ) Notice: Subject to any disclaimer, the term of this patent is extended or adjusted under 35 U.S.C. 154(b) by 650 days.

(21) Appl. No.: 12/260,701

(22) Filed: Oct. 29, 2008

(65) Prior Publication Data

US 2009/0195556 A1 Aug. 6, 2009

Related U.S. Application Data

(60) Provisional application No. 60/985,047, filed on Nov. 2, 2007.

(51) Int. Cl.
*G09G 5/00* (2006.01)

(52) U.S. Cl. ..... 345/619; 345/629

(58) Field of Classification Search ..... 345/629, 345/619

See application file for complete search history.

(56) References Cited

U.S. PATENT DOCUMENTS

| | | | | |
|---|---|---|---|---|
| 7,302,114 | B2 * | 11/2007 | Lunetta et al. | 382/284 |
| 2002/0105529 | A1 * | 8/2002 | Bowser et al. | 345/629 |
| 2009/0070673 | A1 * | 3/2009 | Barkan et al. | 715/716 |

* cited by examiner

*Primary Examiner* — Jacinta M Crawford
(74) *Attorney, Agent, or Firm* — Brinks Hofer Gilson & Lione

(57) ABSTRACT

A system compositing images from different applications includes a movie clip based application, an image application, and a compositing application that is in communication with the movie clip based application and the image application. The movie clip based application defines one or more movie clip images for display. The image application provides one or more images for display with the one or more movie clip images. The compositing application operates to composite the one or more movie clip images with the one or more images of the image application for viewing on a display.

20 Claims, 7 Drawing Sheets

SYSTEM COMPOSITING IMAGES FROM MULTIPLE APPLICATIONS

PRIORITY CLAIM

This application claims the benefit of priority from U.S. Provisional Application No. 60/985,047, filed Nov. 2, 2007, which is hereby incorporated by reference.

BACKGROUND OF THE INVENTION

1. Technical Field

The present invention relates to a system for displaying images to a user and, more particularly, to a system compositing images from multiple, different applications.

2. Related Art

Devices that display images are used in a wide range of applications. MP3 players may display images of an artist and/or album artwork associated with its stored media content. Video players may display streaming video from a memory storage device, a private network, and/or the Internet. Cellular phones may display streaming video from a memory storage device, a private network, the Internet, and/or another cellular phone subscriber.

The user may be provided with an interface for interacting with the device. The interface may include a hardwired interface and/or a virtual interface. Hardwired interfaces may include pushbutton switches, rotary switches/potentiometers, sliders, and other mechanical based items. Virtual interfaces may be implemented using virtual buttons, virtual sliders, virtual rotator controls, function identifiers, and other visual elements on a display, such as a touchscreen display. In a combined interface, function identifiers may be placed on a display adjacent corresponding mechanical based items, such as switches.

The development of a virtual interface and/or display may become complicated when the interface must display an image and/or images from different applications. Still images and/or video images may be integrated with one another in a single application package for playback. This approach, however, limits still images and/or video playback to the images and/or video integrated within the application. Other approaches to combining images and/or video images may be complicated and require extensive use of a non-standard virtual interface development environment.

SUMMARY

A system compositing images from different applications includes a movie clip based application, an image application, and a compositing application that is in communication with the movie clip based application and the image application. The movie clip based application defines one or more movie clip images for display. The image application provides one or more images for display with the one or more movie clip images. The compositing application operates to composite the one or more movie clip images with the one or more images of the image application for viewing on a display.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
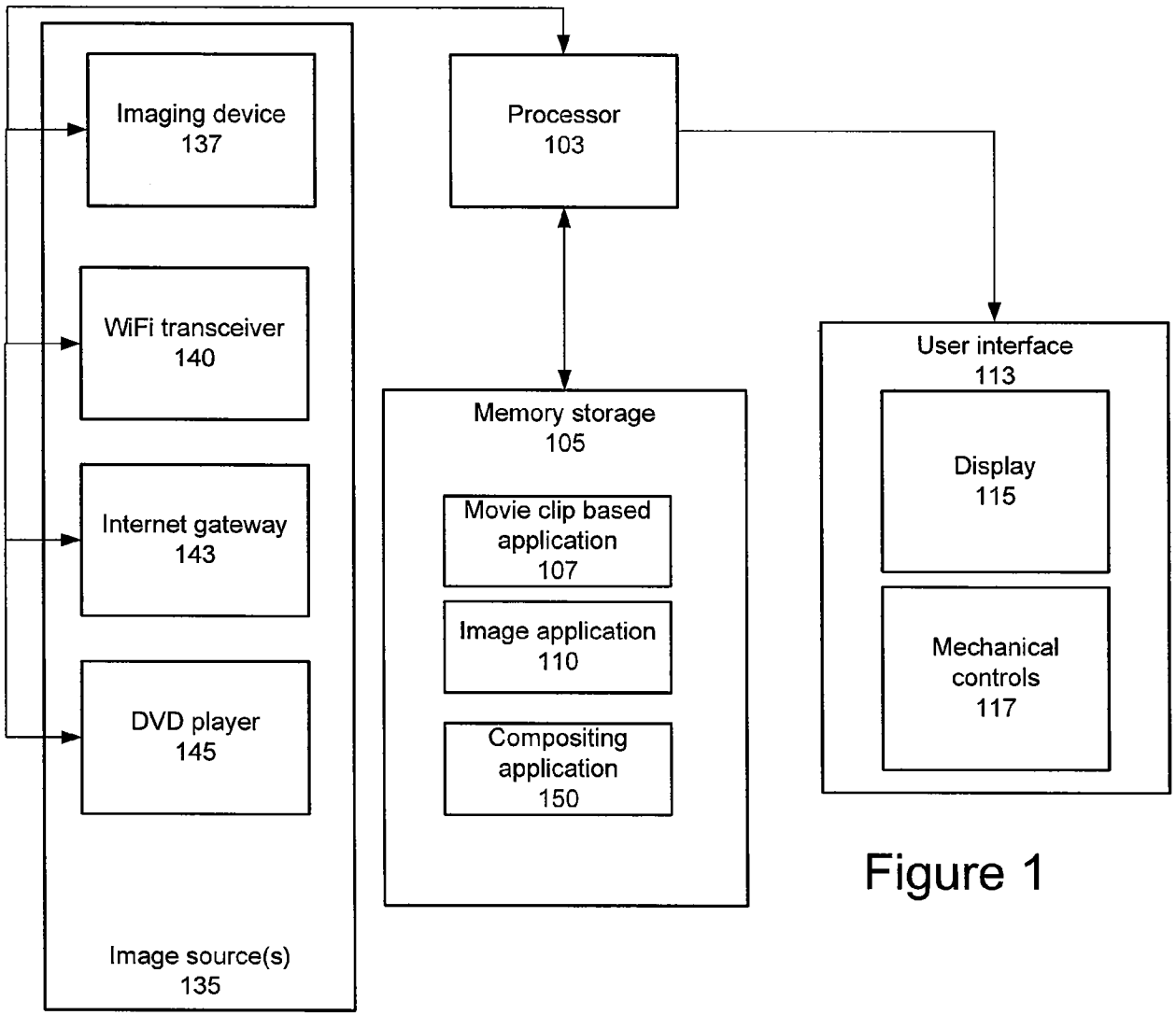
FIG. 1 shows a system that composites movie clip images from a movie clip based application with an image provided from an image application.

FIG. 1 shows a system 100 that composites images from multiple applications for display with one another. Although the system 100 may composite images from multiple generalized applications, system 100 of FIG. 1 implements a composited user interface. System 100 composites an image from a movie clip based application, such as a user interface application that generates one or more user interface images/controls, with an image from an image application.

System 100 includes a processor 103 that may interface with memory storage 105. Memory storage may include a movie clip based application 107 and an image application 110. Movie clip based application 107 is executable by the processor 103 and may be used to determine how a user interacts with system 100 through user interface 113. User interface 113 may include a display 115, such as a touchscreen display, and/or mechanical controls 117.

The processor 103 may interface with various image sources 135 that may be controlled by an image application 110. The image application 110 is executable by the processor 103 and may receive image information from the various image sources 135 for display on display 115. In FIG. 1, the image sources 135 include an imaging device 137 (i.e., a still camera, a video camera, a scanner, or other image acquisition device), a WiFi transceiver 140 connected to receive images over a WiFi network, an Internet gateway 143 to obtain web page images and/or web video, and a DVD player 145 to provide images, still or video, from optical media storage.

The movie clip based application 107 and image application 110 may communicate with a compositing application 150 that composites one or more movie clip images of the movie clip based application 107 with one or more images of the image application 110 on display 115. The compositing application may include one or more image decoders 130, such as a DVD decoder. The compositing application 150 may show an image from the image application 110 in a masked region defined by the movie clip based application 107 based on a masking criterion. The masked region may correspond to a movie clip having a defined masking criterion. Various masking criterion may be used. System 100 may use the alpha channel value of an image in the masked region and/or the chromakey channel value of an image in the masked region. Additionally, or in the alternative, the compositing application 150 may composite movie clip images with images from the image application 110 using compositing information defined by the movie clip based application 107 and/or the image application 110.

Figure 2:
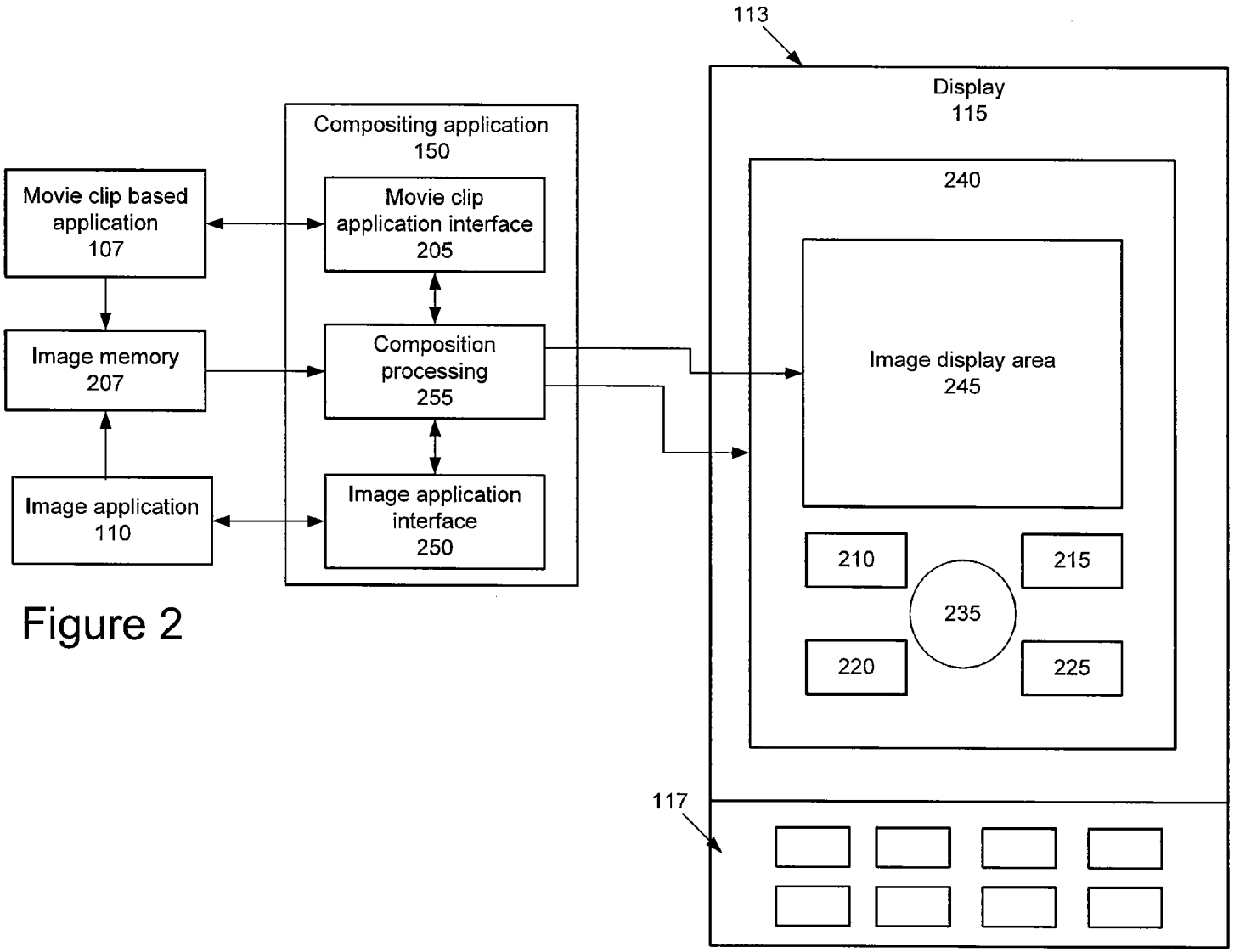
FIG. 2 illustrates how the movie clip based application and image application may cooperate with a multilayer graphics controller and with one another to implement user interface.

FIG. 2 illustrates how the movie clip based application 107 and image application 110 may cooperate with the composition application 150 and with one another to implement user interface 113. In FIG. 2, the user interface 113 includes display 115 and mechanical controls 117. Movie clip based application 107 may be an application, such as a FLASH® player that is adapted to play an .swf file. The .swf file may include various movie clip based controls employed by the user interface 113. The movie clip based application 107 and image application 110 may store their images in respective portions of image memory 207. Image memory 207 is accessible to the compositing application 150.

The movie clip based application 107 may provide information corresponding to the images for movie clip based controls to a movie clip application interface 205 of the compositing application 150. This information may include the memory location(s) in image memory 207 at which the various movie clip images are stored. The compositing application 150 may access these images from memory storage and display the controls in the manner dictated by the movie clip based application 107 on display 115. In FIG. 2, the movie based clips include controls 210, 215, 220, 225, and 235. A decorative background bezel 240 may also be provided as a movie based clip.

The display 115 includes an image display area 245 for displaying images provided by the image application 110. The image display area 245 may correspond to a masked display region that may be defined by the movie clip based application 107. Image display area 245 may be a movie based clip having characteristics corresponding to the masking. For example, image display area 245 may have a color corresponding to a chromakey color mask. The image display area 230 may be a solid color, such as green or blue, although other colors may also be used. Additionally, or in the alternative, image display area 230 may have an alpha channel value corresponding to a mask.

The image application 110 may provide information corresponding to the images that are to be composited with the movie clip based controls through an image application interface 250 of the compositing application 150. This information may include the memory location(s) in image memory 207 at which the images are stored. The compositing application 150 may access these images from memory storage and use a composition processing module 255 to display the images in the manner dictated by the movie clip based application 107 on display 115. In FIG. 2, the image of the image application 110 is displayed in the image display area 245. The image may correspond to still images, webpage data, video, or other image information The movie clip based application 107 and image application 110 may interact with one another through the compositing application 150. Manipulation of a control 210, 215, 220, 225, and/or 235 may be detected by the movie clip based application 107. movie clip based application 107 may also interpret the manipulation and communicate this interpretation to the compositing application 150 for further communication to the image application 110. In response, the image application 110 may execute a corresponding operation. Additionally, or in the alternative, the image application 110 may interpret the manipulation provided by the movie clip based application 107.

Figure 3:
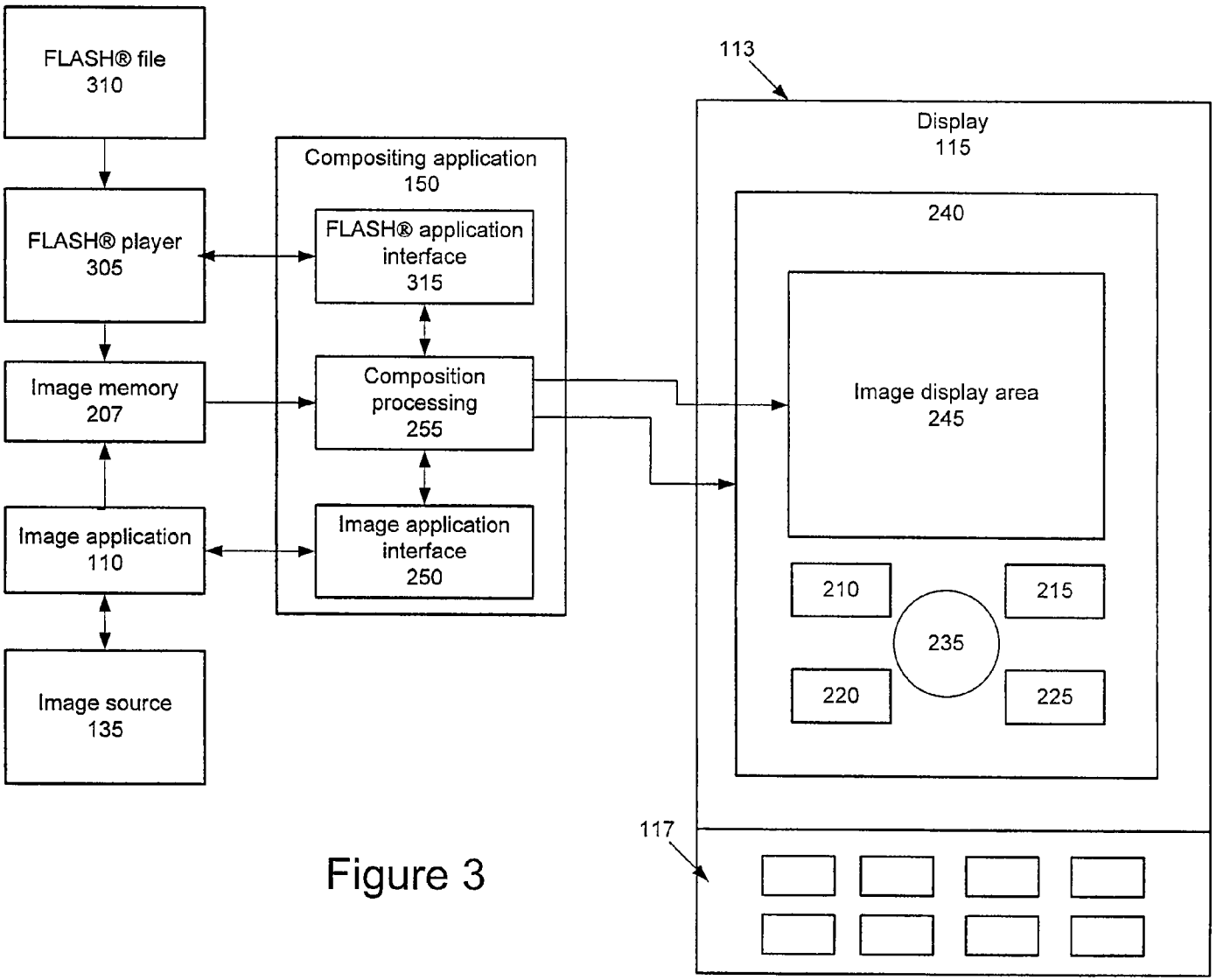
FIG. 3 shows how the compositing system may be implemented in a FLASH® environment.

FIG. 3 shows how user interface 113 may be implemented in a FLASH® environment. In FIG. 3, a FLASH® player 305 is used to play a FLASH® file 310. The FLASH® player 305 may store images used to play FLASH® file 310 in image memory 207. Information corresponding to the images stored in image memory 207 may be provided to the compositing application 150 through a FLASH® application interface 305. This information may correspond to the memory locations of image memory 207 at which the FLASH® images are stored. These images may be accessed by the composition processing module 255 of the compositing application 150.

The image application 110 and image type provided for display in image display area 245 may vary depending on image source 135. For example, image application 110 may include a DVD interface application that provides DVD video from a DVD player 145 (FIG. 1) for playback in image display area 245. Image application 110 may also include a web-based video player for playback of video streams and/or web pages acquired through Internet gateway 143. Other image applications and sources may also be used.

The user interface 113 may be readily changed by playing back a different FLASH® file 310. This functionality may be used to change the user interface 113 in response to changes in the image source 135 and/or image application 110. When the image source 135 is a DVD player, a FLASH® file 310 having controls corresponding to a DVD player may be used to generate the user interface 113. Controls 210, 215, 220, 225, and/or 235 may correspond to such functions as play, rewind, forward, reverse, volume, and other DVD player functions. When a control is manipulated by a user, its function may be interpreted by the FLASH® player 305. The FLASH® player 305 may notify the image application 110 of the function request, either directly or through the compositing application 150. The image application 110 may either execute the requested function or deny its execution. If denied, the FLASH® player 305 may provide an indication of the denial to the user based on the programming in the FLASH® file 310.

Figure 4:
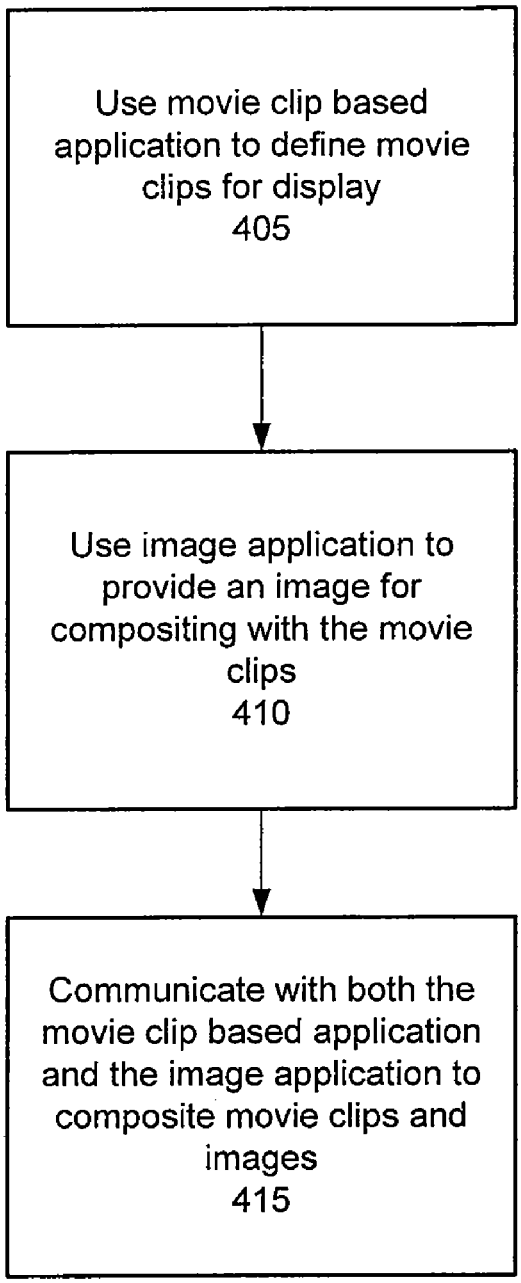
FIG. 4 shows operations that may be used to implement a system having composited images.

FIG. 4 shows operations that may be used to provide a composited image using images from different applications. At 405, a movie clip based application, such as a user interface application, may be used to define movie clips for display. The movie clip based application may also be used to define a masked image display region using a movie clip with a masking characteristic recognized by the compositing application 150. At 410, an image application may be used to provide an image for compositing with the movie clips. A compositing application communicates with both the movie clip based application and the image application at 415 to composite the images with one another. The compositing operations may be based on the criterion used to define the masked image display region.

Figure 5:
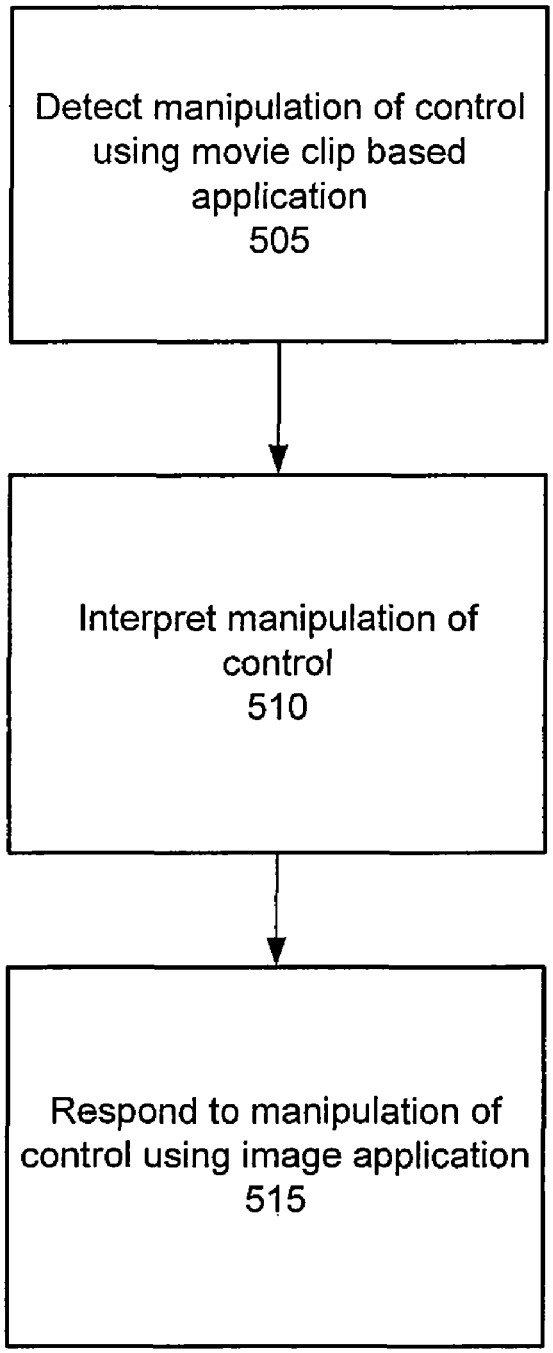
FIG. 5 shows how the system may respond to the manipulation of a movie clip control.

FIG. 5 shows how the system 100 may respond to the manipulation of a user interface control. At 505, a movie clip based application, such as a user interface application, detects manipulation of a user interface control. At 510, the function associated with the manipulation is interpreted. This interpretation may be performed by the movie clip based application or by an image application. At 515, the image application responds to the manipulation of the control and executes the requested operation. Depending on the function associated with manipulation of the control, the function may also be executed by the movie clip based application or a further application.

Figure 6:
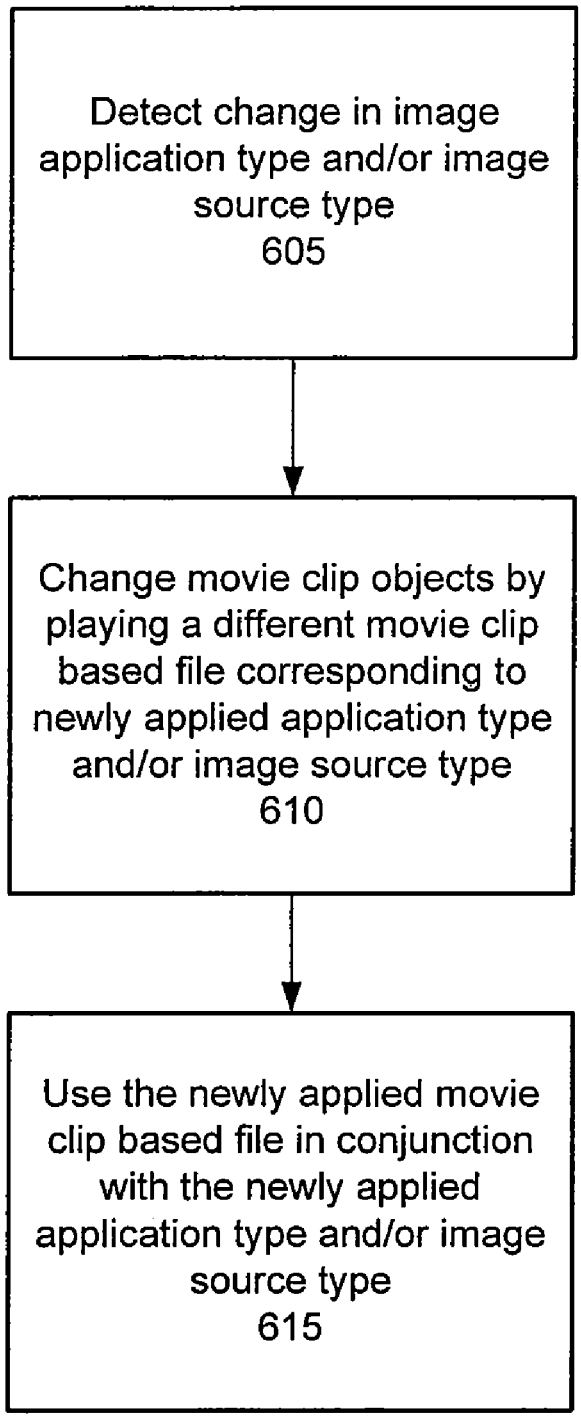
FIG. 6 shows how a movie clip based application may be changed in response to corresponding changes of an image application type and/or image source type.

FIG. 6 shows how a movie clip based application, such as a user interface application, may be changed in response to corresponding changes of an image application type and/or image source type. At 605, the system detects a change in the image application type and/or image source type that is used to provide images to an image display region of the user interface. The user interface application may respond to this change by changing the movie clip objects that it is currently using for the user interface. At 610, the movie clip objects may be changed by playing a different movie clip based file corresponding to the newly applied image application type and/or image source type. At 615, the newly applied movie clip based file is used in conjunction with the newly applied application type and/or image source type to implement the user interface.

Figure 7:
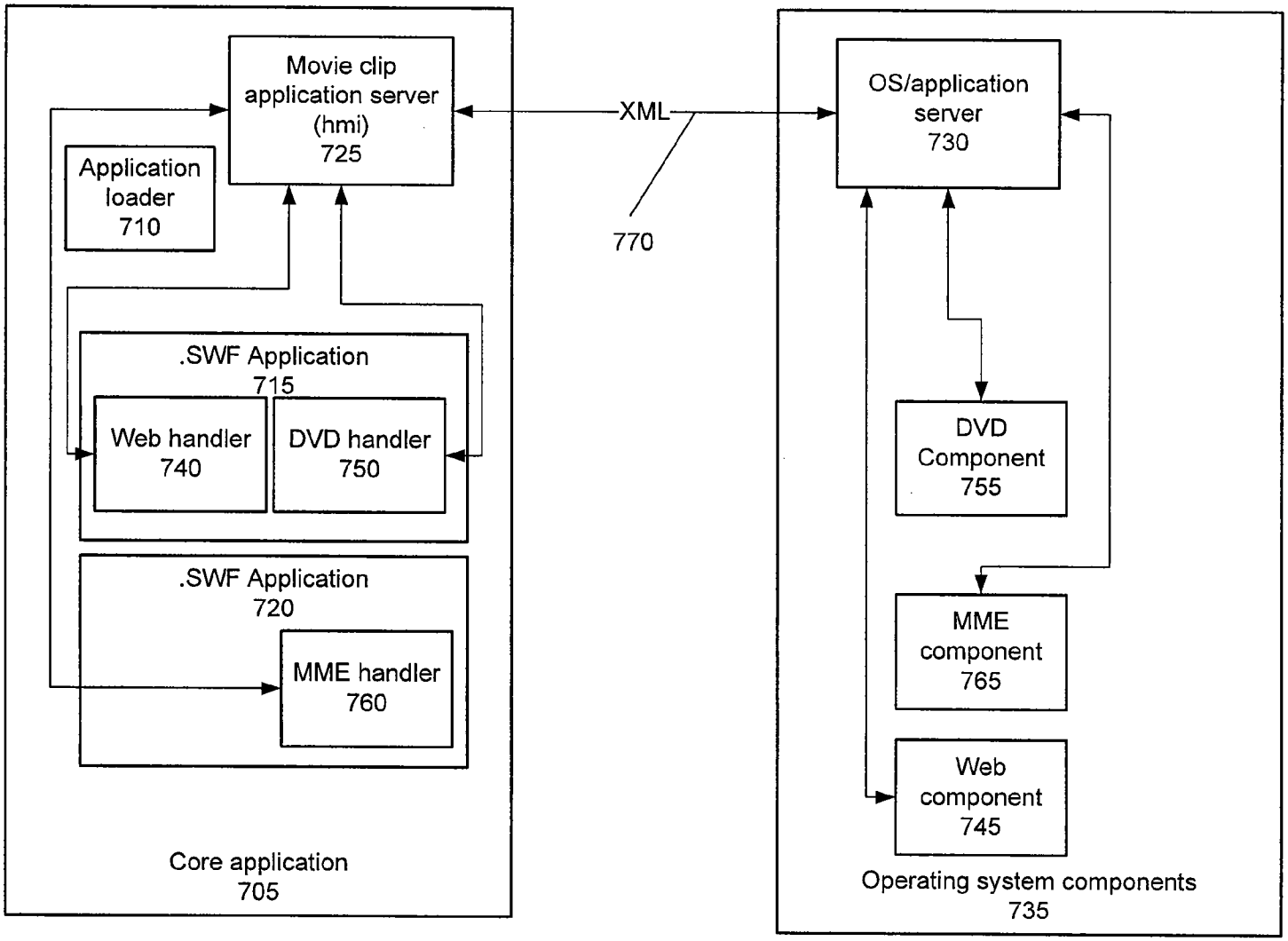
FIG. 7 illustrates how a movie clip based application may communicate with a compositing application.

FIG. 7 illustrates how a movie clip based application may communicate with a compositing application, such as an operating system. The movie clip based application may include a core application 705 and a plurality of instantiated software classes. If the movie clip based application is implemented in a FLASH® environment, the software classes may be implemented using ActionScript®.

In FIG. 7, an instance of an application loader class 710 may be used to load a first movie clip based application 715 and a second movie clip based application 720. The application loader 710 may include the following methods:

```
app_mc = loadApp ( mc, filename, delayunload, lockroot );
getCurrentApp( );
getPreviousApp( );
unloadPreviousApp( );
res_mc = loadResidentApp( mc, filename, appname );
unloadResidentApp( appname );
getResidentApp( appname );
addInterval( interval );
removeInterval( interval );
```

Additionally, the application loader 710 may dispatch the following events:

```
exitCleanUp (Function call)
    Allows the current application to cleanup (remove intervals,
    listeners, etc.) before loading a new application.
appLoaded/resLoaded
    Used for application transitions and/or application setup/config here
appError/resError
    Called if an application fails to load
```

A movie clip application server 725 is used to communicate with a corresponding operating system server 730 included as one of a plurality of operating system components 735. The movie clip application server 725 is also in communication with one or more component handlers associated with applications 715 and 720. The component handlers may be responsible for communicating commands and handling events associated with corresponding operating system components. In FIG. 7, application 715 includes a web handler 740 for communicating commands and handling events associated with web component 745, and a DVD handler 750 for communicating commands and handling events associated with DVD component 755. The web component 745 may control a web browser that runs as a stand-alone application in the operating system. It may be used to display a web page at a certain screen position that may be defined by application 715 through web handler 740. Additionally, the web component 745 may respond to web browser commands (e.g., back/forward/new URL, mouse click, scroll bar moving, or other command) provided by application 715 through web handler 740.

The DVD component 755 may control a DVD player that runs as a stand-alone application in the operating system. It may be used to display DVD video at a certain screen position that may be defined by application 715 through DVD handler 750. Additionally, the DVD component 755 may respond to DVD player commands (e.g., play, fast-forward, reverse, volume, forward chapter, reverse chapter, or other command) provided by application 715 through DVD handler 750.

Application 720 may include a multimedia engine (MME) handler 760 for communicating commands and handling events associated with a multimedia engine (MME) component 765 of the operating system. This MME component 765 may be used to control multimedia middleware to perform various multimedia functions. MME components 765 may be used to position media thumbnails on a display based on commands received from application 720 through MME handler 760. Other functions include acquiring a device list, song/album list, audio playback, playback zone selection, and other multimedia functions.

The component handlers of the core application 705 are attached for communication with the movie clip application server 725. The following code may be used in attaching the handlers shown in FIG. 7:

Web Handler Example

```
webh =
WEBHHandler( oCore.hmi.checkHandler( WEBHHandler.HTYPE ) );
if ( webh== null ) {
  webh = new WEBHHandler( );
  webh.attachServer( oCore.hmi );
}
```

MME Handler Example

```
mme = MMEHandler( oCore.hmi.checkHandler(
MMEHandler.HTYPE ) );
if ( mme == null ) {
  mme = new MMEHandler( );
  mme.attachServer( oCore.hmi );
```

DVD Handler Example

```
dvd = DVDHandler( oCore.hmi.checkHandler( DVDHandler.HTYPE ) );
if( dvd== null ) {
  dvd = new DVDHandler( );
  dvd.attachServer( oCore.hmi );
}
```

With the handlers attached to the movie clip application server 725, applications 715 and 720 may communicate with the corresponding components of the operating system. In FIG. 7, the handlers communicate with movie clip application server 725, which communicates with the operating system server 730 over a software communication link 770. The operating system server 730 communicates information to and from the respective component.

Communications between the movie clip application server 725 and the operating system application server 730 may be based on an XML protocol. The communications from the movie clip application server 725 to the operating system server 730 may have the following format:

```
<qcomp
name="component_name"><t>type</t>
<a>action</a><p><arg0>arg0</arg0><arg1>arg1
</arg1>....<argN>argN</argN></p></qcomp>
```

In this format, the component_name may identify the target component for the message. The xml string between <qcomp> . . . </qcomp> may be passed to the component for processing. The type and action may be used to identify the command that the component is to perform. For example, the MME handler 760 may send <t>trace</t><a>list</a> to the movie clip application server 725 which, in turn, incorporates this type and action into the XML protocol format for transmission to the operating system server 730. The operating system server 730 may strip any unneeded information from the transmission before the information is sent to MME component 765 for execution. The <arg0> . . . </argN> between  and  may be used to pass arguments to a component for processing.

The movie clip application server 725 may send one message at a time to the operating system server 730. It may wait for an acknowledgment from the operating system server 730 before sending another message. The acknowledgment from the operating system server 730 may have the following format;

<qcomp><ack></ack></qcomp>

A component may send a message back to the corresponding handler using communications from the operating system server 730 to the movie clip application server 725 over link 770. The message may include data, an event, or similar information. Communications from the operating system server 730 to the movie clip application server 725 may have the following format:

```
<qcomp
name="component_name"><t>type</t><a>action</a>
<p>any_xml_formated_data</p ></qcomp>
```

The MME component 765 may send the following event to the movie clip application server 725, to indicate a track session id:

```
<qcomp
name="mme"><t>event</t><a>evtrksession</a><p>
<tsid>1</tsid></p></qcomp>
```

The communications over link 770 may include various types of information specific to the various components and their corresponding handlers. In compositing images, the location of a webpage on a display may be dictated by the application 715 to the web component 745 using communications from web handler 740. The location of DVD video on a display may be dictated by the application 715 to the DVD component 755 using communications from web handler 750.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A media device comprising:

a display;

one or more processors;

memory; and one or more applications; where the applications are stored in the memory and are configured to be executed by the one or more processors, the one or more applications include a first application for generating and rendering one or more user interface objects on the display with which a user interacts and a second application for executing one or more functions corresponding to the one or more user interface objects on the display with which the user interacts, the second application including a content application interface that connects an image source to the one or more processors and enables one or more images received from the image source to be rendered on the display;

the first application further including instructions for:

detecting a manipulation of the one or more user interface objects rendered on the display; and transmitting the detected manipulation of the one or more interface objects to the second application;

where the functions corresponding to the detected manipulation of the one or more user interface objects rendered on the display perform actions on or associated with the one or more images received from the image source.

2. The media device of claim 1 where the user interface objects comprise control images used to activate the one or more functions and the one or more applications further comprise a compositing application that combines the one or more images received from the image source with the control images in response to information received from the first application.

3. The media device of claim 2 where the first application further includes instructions for transmitting the location of the one or more user interface objects stored in the memory to the compositing application.

4. The media device of claim 1 where the user interface objects comprise control images used to activate the one or more functions and the one or more applications further comprise a composting application that combines the one or more images received from the image source with the control images in response to information received from the second application.

5. The media device of claim 1 comprising communicating information from the second application to the first application.

6. The media device of claim 1 where the user interface objects comprise one or more animated vector graphics or one or more applets.

7. The media device of claim 1 where the first application comprises a movie clip based application.

8. The media device of claim 1 where the second application comprises an image application.

9. The media device of claim 1 where the display comprises a touch screen display.

10. The system according to claim 1 where the image source comprises one or more of a still camera, a video camera, a scanner, a wireless network, a publicly accessible distributed network, a DVD player or an optical media storage; and the one or more images processed by the second application comprises one or more of still images, video images, video streams, web pages and DVD video.

11. A media device comprising:

a display;

one or more processors;

memory; and one or more applications; where the applications are stored in the memory and are configured to be executed by the one or more processors, the one or more applications include a first application for generating and rendering one or more user interface objects on the display with which a user interacts and a second application for executing one or more functions corresponding to the one or more user interface objects on the display with which the user interacts, the second application including a content application interface that connects an image source to the one or more processors and enables one or more images received from the image source to be rendered on the display;

the first application further including instructions for:

detecting a manipulation of the one or more user interface objects rendered on the display; and interpreting the one or more functions corresponding to the detected manipulation of the one or more user interface objects rendered on the display;

where the functions corresponding to the detected manipulation of the one or more user interface objects rendered on the display performs an action on or associated with the one or more images received from the image source.

12. The media device of claim 11 comprising transmitting the manipulation of the one or more interface objects to the second application.

13. The media device of claim 11 where the first application and the second application cooperate to implement the rendering of the one or more user interface objects on the display or the one or more images on the display.

14. The media device of claim 11 where the user interface objects comprise control images used to activate the one or more functions and the one or more applications further comprise a compositing application that combines the one or more images received from the image source with the control images in response to information received from the first application.

15. The media device of claim 14 where the first application further includes instructions for transmitting the location of the one or more user interface objects stored in the memory to the compositing application.

16. The media device of claim 11 where the user interface objects comprise animated vector graphics or one or more applets.

17. The media device of claim 11 where the first application comprises a movie clip based application.

18. A media device comprising:

a display;

one or more processors;

memory; and one or more applications; where the applications are stored in the memory and are configured to be executed by the one or more processors, the one or more applications include a first application for generating and rendering one or more user interface objects on the display with which a user interacts and a second application for executing one or more operations corresponding to the one or more user interface objects on the display with which the user interacts, the second application including a content application interface that connects a first remote image source to the one or more processors and enables one or more images received from the first remote image source to be rendered on the display; the second application further including instructions for:

changing the one or more user interface objects rendered on the display in response to changes in the types of the one or more images received from the first remote image source or in response to a change from the first remote image source to a second remote image source.

19. The media device of claim 18 where the user interface objects comprise animated vector graphics or one or more applets.

20. The media device of claim 18 where the first application and the second application cooperate to implement rendering of the one or more user interface objects and the one or more images on the display.

* * * * *